US005868774A

United States Patent [19]

Reil

[11] Patent Number: 5,868,774

[45] Date of Patent: Feb. 9, 1999

[54] UNIQUE CARTRIDGE AND EARRING STUD GUN SYSTEM

[76] Inventor: Vladimir Reil, 32450 Nautilus Dr., Rancho Palos Verdes, Calif. 90275

[21] Appl. No.: 8,763

[22] Filed: Jan. 19, 1998

Related U.S. Application Data

[63] Continuation-in-part of Ser. No. 754,411, Nov. 21, 1996, Pat. No. 5,792,170.

[51] Int. Cl.[6] ..... A61B 17/00

[52] U.S. Cl. ..... 606/188

[58] Field of Search ..... 606/188, 185, 606/117; 227/67, 73

[56] References Cited

U.S. PATENT DOCUMENTS

| | | | |
|---|---|---|---|
| 282,779 | 2/1883 | Reil . | |
| 315,211 | 3/1885 | Reil . | |
| 347,895 | 6/1886 | Mann . | |
| 358,210 | 5/1887 | Reil . | |
| 366,316 | 1/1887 | Reil . | |
| 2,798,491 | 7/1957 | Samuels . | |
| 3,941,134 | 3/1976 | McDonald . | |
| 4,030,507 | 6/1977 | Mann . | |
| 4,146,032 | 3/1979 | Rubenstein et al. . | |
| 4,527,563 | 7/1985 | Reil . | |
| 4,860,747 | 8/1989 | Sciara . | |
| 4,921,494 | 5/1990 | Reil . | |
| 4,931,060 | 6/1990 | Aue . | |
| 5,004,470 | 4/1991 | Mann . | |
| 5,004,471 | 4/1991 | Mann . | |
| 5,007,918 | 4/1991 | Mann . | |
| 5,211,653 | 5/1993 | Nakajima | 606/188 |
| 5,263,960 | 11/1993 | Mann . | |
| 5,350,394 | 9/1994 | Mann . | |
| 5,360,434 | 11/1994 | Mann . | |
| 5,389,105 | 2/1995 | Mann . | |
| 5,496,343 | 3/1996 | Reil . | |
| 5,499,993 | 3/1996 | Blomdahl et al. . | |

*Primary Examiner*—William Lewis

[57] ABSTRACT

A system for providing pierced-ear instruments. A sealed blister pack creates and maintains a sterile environment in which an earring cartridge with a pierced-ear earring stud may be transported and stored. An earring-cartridge stud gun provides a cradle into which the earring cartridge may fit. Upon removal of backing paper imperviously sealing the blister pack, the cradle provided by the earring-cartridge stud gun is accommodated by and fits within the blister pack to engage and remove the sterile earring cartridge from the blister pack. Upon sterilization of the ear tissue, the ear may be pierced. Once the ear has been pierced, the pierced-ear earring stud is easily disengaged from the earring cartridge. The blister pack may then re-engage the now-used earring cartridge to remove it from the stud gun cradle. The earring-cartridge stud gun is then available to receive another sterile earring cartridge to repeat the ear-piercing process on the same or other ear. The present system reduces and avoids contamination of the earring cartridge and the pierced-ear earring stud as no manual contact need ever take place between the sterile earring cartridge and a person's hands.

4 Claims, 4 Drawing Sheets

UNIQUE CARTRIDGE AND EARRING STUD GUN SYSTEM

CROSS-REFERENCES TO RELATED APPLICATIONS

This application is a continuation-in-part of application of U.S. patent application Ser. No. 08/754,411 filed Nov. 21, 1996, now U.S. Pat. No. 5,792,170.

BACKGROUND OF THE INVENTION

1. Field of the Invention

This invention relates to ear-piercing devices and, more particularly, to an ear-piercing stud gun that accepts a pre-sterilized cartridge containing an earring stud and clutch/nut.

2. Description of the Related Art

Body piercing is increasingly becoming a more commonplace fashion statement. However, the prevalence of pierced ears and pierced-ear earrings remains in the marketplace as the predominant form of body piercing sustained today.

In the past, ear piercing has been a minor surgical procedure performed by a doctor or other skilled medical practitioner, such as a nurse. Increasingly, more routine procedures are used to pierce ears, such procedures performed by laypersons without great medical experience or training. While the performance of the ear-piercing operation is generally straightforward and fairly easy to understand, it is still important to maintain a sterile environment adjacent the pierced flesh in order to reduce any chance of infection or any other deleterious consequences.

To this end, a number of approaches have been made to provide simple, manually operated devices that allow for the easier piercing of ears while creating and maintaining sterile conditions.

One example of such a system is disclosed in U.S. Pat. No. 5,496,343 issued to Reil on Mar. 5, 1996, Application Ser. No. 292,249 filed Aug. 18, 1994, incorporated herein by this reference.

In the Reil '343 patent, a hand-held disposable ear piercer is disclosed that allows for the piercing of ears. Such a system is not necessarily used in a sterile environment, and all of the portions of the Reil '343 piercer must be made sterile (such as the post P), as does the tissue to be pierced, namely, the ear lobe.

While there are great advantages to systems such as that disclosed in the Reil '343 patent, it would also be additionally advantageous to provide a sterile cartridge so that it might be used without deleterious effects. Additionally, such an ear piercer might be engaged by a stud gun or the like which, by cradling the ear-piercing cartridge, serves to better distribute the manual forces and to allow easier manual manipulation and articulation before, during, and after the ear-piercing process. In order to keep the ear-piercing cartridge in a sterile environment, a closed container of an easily manufactured and disposable sort might be provided. Such a container could advantageously allow easier manual manipulation and engagement of the ear-piercing cartridge by the stud gun.

By providing such a system, a disposable ear-piercing cartridge (such as that of the Reil '343 patent) is more advantageously used, decreasing the chance of any deleterious effects arising during the ear-piercing process.

SUMMARY OF THE INVENTION

The present invention resides in a system for better wielding a disposable, hand-held ear-piercing cartridge so that sterile instruments may be established and maintained as well as better controlling the ear-piercing processing.

The system set forth in the present invention is centered upon a disposable ear-piercing cartridge along the lines of the Reil '343 patent, above. A stud gun provides a telescoping-like compression cradle into which the disposable ear-piercing cartridge fits. The stud gun fits comfortably into the hand and may be grasped between the heel of the hand and the fingers. This provides better control and more muscular power whereby the stud gun may be wielded with more control during the ear-piercing process.

A sterilizable blister pack, having a peel-away bottom, provides a sterile and sterilizable container that allows the ear-piercing cartridge to be sterilized and maintained in a sterile condition until just prior to use. The blister pack is conformably and congruently configured so as to closely accommodate the ear-piercing cartridge. Additionally, the blister pack also allows the insertion of the ear-piercing cartridge into the stud-gun cradle so that the cradle may firmly engage the disposed cartridge. Once firmly engaged with the stud-gun cradle, the ear-piercing cartridge may be removed from the blister pack without contact with a person's hands during the engagement process. The blister pack may then be removed, leaving exposed the sterile ear-piercing post and clutch. The ear lobe to be pierced may then be pierced when placed between the post and the clutch.

Once the ear-piercing process has been completed, the ear-inserted stud and clutch making up the pierced earring is freed from the ear-piercing cartridge. The ear-piercing cartridge may then be reinserted into the blister pack without the pierced earring for appropriate disposal. The earring cartridge may then be removed from the stud-gun cradle and the stud-gun cradle readied to receive another sterile ear-piercing cartridge in a second blister pack where dual ear, etc., piercing is desired.

OBJECTS OF THE INVENTION

It is an object of the present invention to provide a better means by which ears may be pierced.

It is another object of the present invention to provide easier ear-piercing means that are more controllable and more easily handled by persons without a high degree of medical training.

It is yet another object of the present invention to provide an easier ear-piercing means that creates and maintains sterile ear-piercing instruments.

It is an additional object of the present invention to provide sterilizable and sterile means by which disposable, one-use, ear-piercing cartridges may be transported and stored in a sterile condition until ready for use.

It is an additional object of the present invention to provide a hand-held stud gun that can engage an earring cartridge to better control the cartridge during the ear-piercing process.

It is yet another object of the present invention to provide a sterilizable and sterile blister pack that facilitates engagement and disengagement by an earring cartridge with a stud gun and which earring cartridge is resistant to reuse to ensure that the same is not reused.

These and other objects and advantages of the present invention will be apparent from a review of the following specification and accompanying drawings.

DESCRIPTION OF THE PREFERRED EMBODIMENTS

The present invention resides in the enhanced safety and control delivered by a stud gun holder for an earring cartridge. Earring cartridges are known in the art and are disclosed in the patent application and issued patent to Reil, U.S. Pat. No. 5,496,343 issued on Mar. 5, 1996. That patent and its history are incorporated herein by this reference thereto.

The system of the present invention involves the use of an earring-cartridge stud gun that provides better control over and, therefore, safer use of an earring cartridge. Such earring cartridges are generally small in size as they are meant to accommodate a generally small pierced-ear earring. The reduced size of such earring cartridges demand that they be wielded and controlled by the small finger muscles of a person's hand. The earring-cartridge stud gun of the invention and the system incorporating its use provides means by which precise control can be exerted and maintained over the earring cartridge while allowing the stronger palm muscles of the hand to drive the ear-piercing process.

Additionally, sterile blister-pack means are used to create and maintain a sterile environment for the earring cartridge, the pierced-ear earring cartridge, and the pierced-ear earring during transport and storage. The blister pack also provides sterile means by which the earring cartridge will be maintained in a sterile environment until use, allowing the manipulation and articulation of the earring cartridge without requiring direct contact with human hands or other contaminated and contaminating surfaces. By sterilizing the contact area between the earring-cartridge stud gun and the earring cartridge, a completely sterile environment can be maintained for the instruments used for the ear-piercing process. By swabbing the ear lobe or other body part with alcohol or the like to create a sterile tissue surface, deleterious consequences that often accompany the piercing of ears (such as minor infection) are reduced or entirely avoided.

Figure 5:
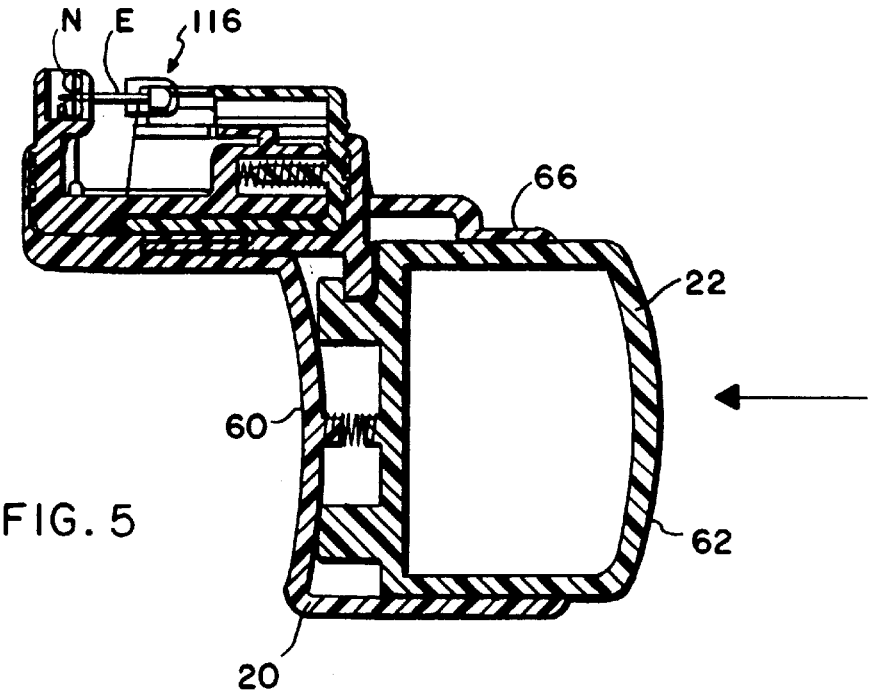
FIG. 5 is a side cross-sectional view of the earring cartridge stud gun and ear piercing cartridge of FIG. 4 taken along line 5—5.
Figure 6:
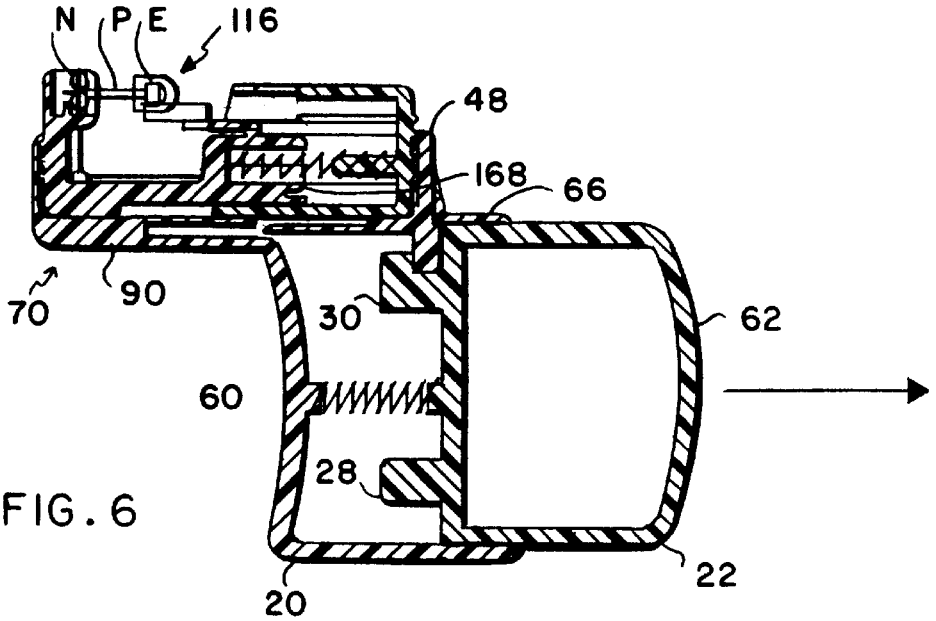
FIG. 6 is a side cross-sectional view of the associated ear-piercing cartridge and stud gun of FIG. 4 when the gun has been "fired" to set the stud and clutch after the ear-piercing process, with the ear or other body part not being shown.

Generally, the figures show the construction and operation of the earring stud-gun-and-cartridge system. The earring stud-gun-and-cartridge system 10 of the present invention is comprised of the earring-cartridge stud gun 12, the earring cartridge 14, and the earring cartridge blister pack 16. Initially, a pierced-ear earring is fitted within a pierced-ear earring cartridge 116 (FIGS. 5, 6). The pierced-ear earring cartridge 116 is then fitted within the earring cartridge 14. The earring cartridge 14 with the earring E fits within the blister pack 16 which is constructed to conform to the exterior shape of the earring cartridge 14. The blister pack 16 is sealed by removable paper 18 adhesively sealed to the blister pack 16. After sealing one or more of the blister packs, ethane dioxide or other sterilizing gas may be used to sterilize the blister pack so that the interior thereof and any contents, including the earring cartridge 14 and earring E are sterilized. Obviously, irradiation for sterilization may be used. During transport and storage, the sterile environment created inside the blister pack is maintained until the seal is broken by removal of the peelable paper backing 18 just prior to the use of the earring cartridge during the ear-piercing process.

The earring cartridge 14 fits within the earring stud gun 12 so that a person's entire hand, not just the fingers, may be used to wield and control the pierced-ear earring prior to and during the ear-piercing process.

Figure 1:
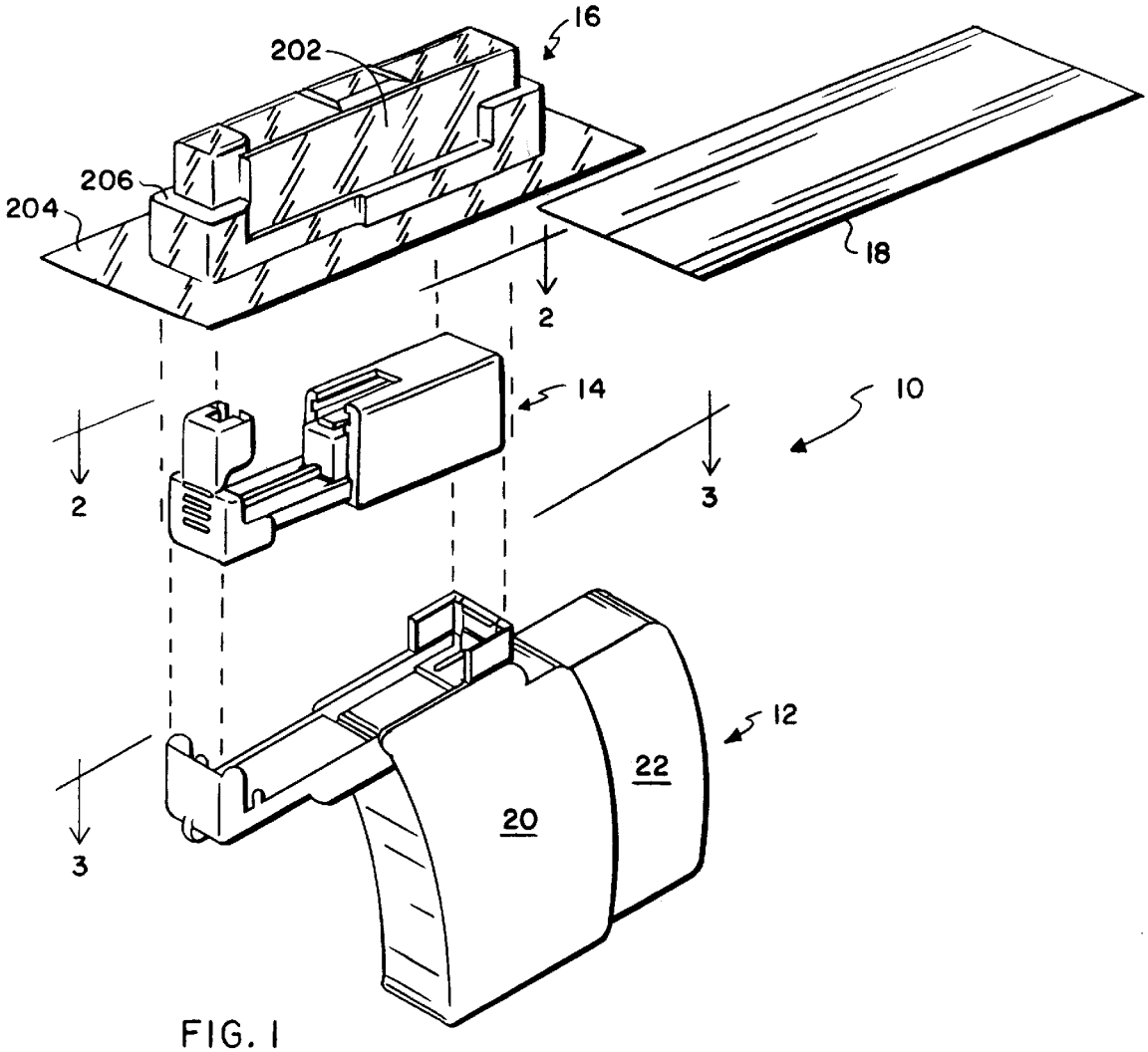
FIG. 1 is an exploded perspective view of the ear-piercing system of the present invention.
Figure 2:
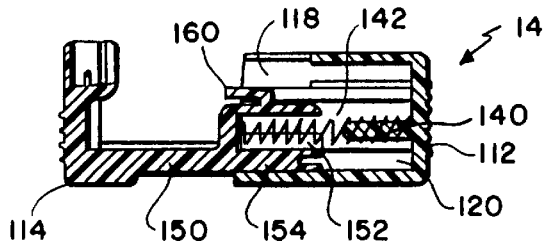
FIG. 2 is a side cross-sectional view of the ear-piercing cartridge of FIG. 1 taken along line 2—2.
Figure 3:
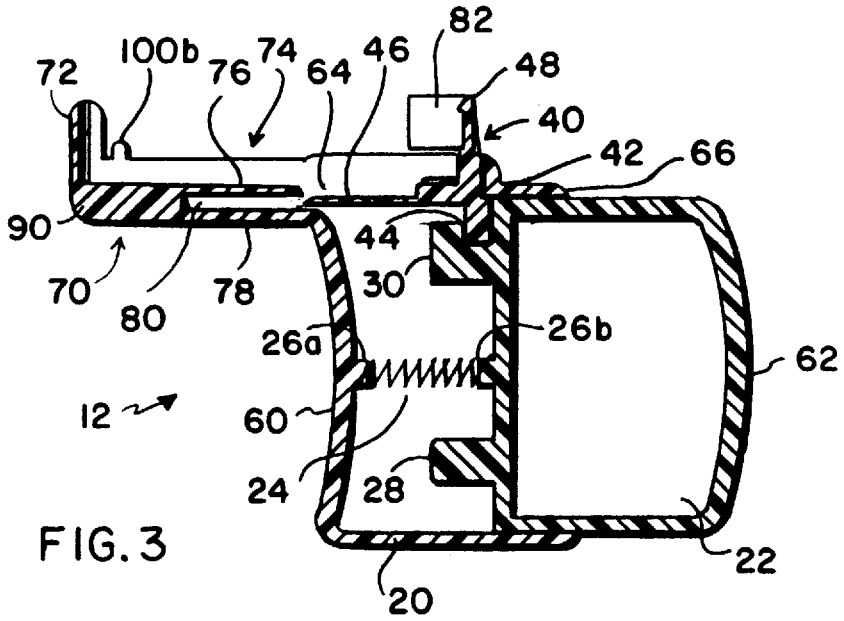
FIG. 3 is a side cross-sectional view of the ear-piercing cartridge stud gun taken along line 3—3 of FIG. 1.
Figure 4:
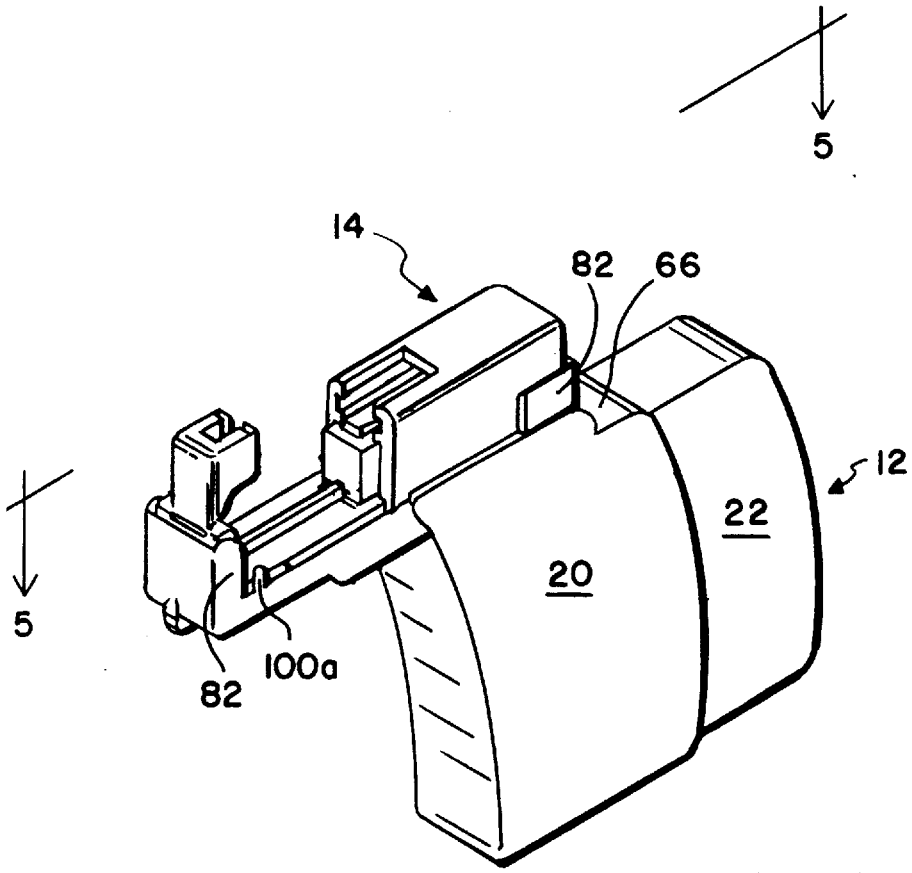
FIG. 4 is a perspective view of the associated ear-piercing cartridge and stud gun when fitted to each other.

The earring-cartridge stud gun 12 is shown in FIGS. 3–6 wherein two inter-fitting portions comprise the earring-cartridge stud gun 12: the grip 20 and the plunger 22. The plunger 22 fits within the grip 20 and slidably travels therethrough a generally short distance, namely, that distance necessary to pierce the ear with the stud portion of the pierced-ear earring. That distance of travel is approximately one-half inch and the plunger 22 is easily controlled by the hand. The length of the plunger-grip assembly is approximately two-and-one-half inches taken along the line L—L as shown in FIG. 4.

As shown in FIG. 3, the plunger 22 is biased by biasing means, such as spring 24, away from the grip 20. Oppositely disposed stud-gun spring posts 26*a, b* serve to hold spring 24 in place between the grip 20 and the plunger 22 in a normally-opposed position. The plunger 22 is held in captive association with grip 20 as set forth in more detail below.

The plunger 22 may be hollow in order to conserve cost, weight and to allow for greater ease of manufacturing. On the inside of the plunger 22 within the grip 20, lower abutment stop 28 and an upper abutment stop 30 serve to limit the forward travel of plunger 22 into the interior of the grip 20. The distance between the contact surfaces of the abutment stops 28, 30, and the grip 20 is approximately one-half inch. The abutment stops 28, 30 may be formed of the same material as the plunger 22 and may be molded as an integral unit with plunger 22.

Upper abutment stop 30 is formed in an L-shape (in cross section) so as to accommodate the traveling portion 40 of the cradle 74 provided by the earring stud gun 12 for the earring cartridge 14. The traveling portion 40 has a depending projection 42 that fits within the notch 44 provided between the upper abutment stop 30 and the plunger 22. Tongue 46 projects laterally forward and away from the plunger 22 to act as an additional travel limiting stop as will be seen. A cradle backstop 48 serves to provide the retaining support and abutment at the back of the earring cartridge 14 once it is fitted into the earring-cartridge stud gun 12 and more specifically, cradle 74 thereof.

Traveling portion 40 is molded as one piece with plunger 22 or may be welded thereto so as to be integral with plunger 22. The traveling portion 40 travels with the plunger 22 due to its connection with the upper abutment stop 30 via the depending portion 42. Along with the plunger 22, the traveling portion 40 slidably travels along any surface of the grip 20 with which it may come into contact except where abutment occurs.

The grip portion 20 has a front-curved surface 60 adapted to fit against the fingers of the hand. In conjunction with the rear curved surface 62 of the plunger 22, the portion of the earring cartridge stud gun 12 engaged by a person's hand fits comfortably within the hand due to the complementary curved surfaces 60, 62. The grip portion 20 is approximately two inches in height, about three inches in overall width, and defines upper slot 64 through which the cradle backstop 48 travels. An abutment or end wall 66 of the slot 64 of the grip portion 20 serves to prevent the rearward travel of the cradle backstop 48 beyond that shown. The abutment 66 between the cradle backstop 48 holds the plunger 22 in sliding association with the grip 20, even though biasing means 24 normally urges them apart.

Projecting forwardly from the top of the grip 20 is a cradle extension 70 that terminates in a cradle forestop 72. The area defined between the cradle forestop 72 and the cradle backstop 48 serves to define a cradle 74 within which the earring cartridge 14 may fit and be telescopically compressed during the ear-piercing process. Provided beneath the upper surface 76 and above the lower surface 78 of the cradle extension 70 is a tongue groove 80. The tongue groove 80 provides travel room for the tongue 46 as it travels forward. As the tongue 46 is captively retained between the upper surface 76 and the lower surface 78 of the cradle extension 70, greater stability and alignment is provided during the ear-piercing process as the cradle 74 maintains its relative geometry and shape during the piercing process.

In order to provide additional support to the cradle extension 70, integrally molded cradle extension support 90 extends forward of the tongue groove 80 and terminates below the forestop 72. The cradle extension support 90 provides additional support to the cradle extension 70, thereby reinforcing it and providing a more secure mechanical connection and greater resistance to deformation or misalignment during the ear-piercing process.

The interior of the cradle 74 has additional means by which the earring cartridge 14 is held and maintained in position. Thus, oppositely disposed across the cradle 74 adjacent the forestop 72 are two side supports 100*a, b*. The cradle side supports 100*a, b* project upwardly approximately an eighth of an inch and provide additional side securement and positioning for the earring cartridge 14. The interior of the backstop 48 and forestop 72 may have notches or ridges by which to engage the ribs present on the earring cartridge. In one embodiment, a small extension or finger (not shown) may extend upwardly from the upper surface 76 of the cradle extension 70 adjacent the forestop 72 to frictionally engage the front end of the earring cartridge 14. Both the backstop 48 and the forestop 72 may have side flange projections 82 to better engage and secure the earring cartridge 14 in the cradle 74.

Having described the earring-cartridge stud gun 12, description is now made of the earring cartridge 14 followed by a description of the blister pack 16. The description of the earring cartridge 14 generally follows that set forth in the patent to Reil, U.S. Pat. No. 5,496,393 issued on Mar. 5, 1996, incorporated herein by this reference thereto.

As shown in FIGS. 1, 2, 4, 5, and 6, the earring cartridge 14 has two slidably connected portions and fits within the cradle 74 provided by the earring-cartridge stud gun 12.

Generally, the earring cartridge 14 has an earring jaw 112 and a nut jaw 114 that slidably articulate with respect to one another. A pierced-ear earring cartridge 116 fits within a top channel 118 present in the earring jaw 112. A second lower channel 120 serves as a guidance-and-alignment means for the nut-jaw extension 154 with its bore 152. The pierced-ear earring cartridge 116 has a frangible tab that engages a flexible tang 160 projecting from the top of the nut-jaw extension 154.

An extending tongue 168 has added in a hook that engages a forward edge of a bottom slot at the bottom of the earring jaw 12. A spring 142 is trapped between a spring post 140 connected to the earring jaw 112 inside the lower chamber 120 and the bore 152 defined in the nut-jaw extension 154.

Figure 7:
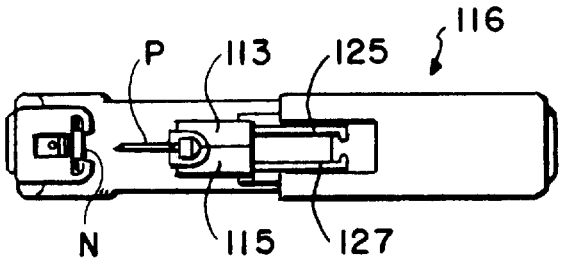
FIG. 7 is a top view of the earring cartridge as the stud is being driven toward the clutch.
Figure 8:
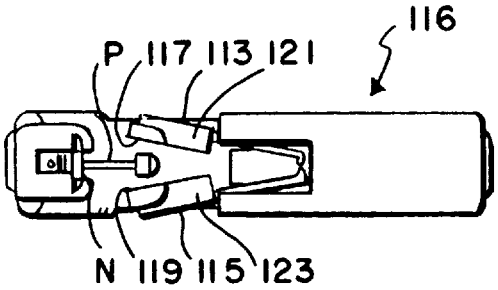
FIG. 8 is a view similar to FIG. 7 but showing the stud engaged with the clutch as also shown in FIG. 6.

Referring to FIGS. 7 and 8, it will be seen that the stud or earring post P is releasably held by oppositely disposed stud-holder halves 113 and 115. Each of the stud-holder halves 113 and 115 have a front stud-head recess 117 and 119, respectively, and a rearward, rectangular portion 121 and 123, respectively; which terminate in termini 125 and 127, respectively. Rectangular portions 121 and 123 are adapted to ride within top channel 118 of cartridge 116 with the retained stud or post P retained in captive relationship therebetween.

The operation of the earring cartridge is set forth in more detail below and follows closely that set forth in the Reil patent, above.

Normally, the earring cartridge spring 142 or other biasing means forces the nut jaw 114 away from the earring jaw 112 as far as the bottom slot and hooked tongue 168 will allow. Ample room is provided between the nut jaw 114 and the earring jaw 112 for the insertion of an earlobe (not shown) or other body part to be pierced. Once the earlobe is placed between the nut jaw 114 and the earring jaw 112, and necessarily between the earring stud or post P and the earring nut N, the earring-cartridge stud gun 12 is squeezed to compress the earring cartridge 14. The earring cartridge 14 is then compressed to bring the back side of the tang post in engagement with the frangible tab. The frangible tab will not break until sufficient force is applied to the earring cartridge 14 by the earring-cartridge stud gun 12. As pressure builds up, the frangible tab holds in place until failure occurs and the frangible tab breaks free of the pierced ear earring cartridge 116.

With the breaking of the frangible tab, the nut jaw 114 is now free to move towards the earring jaw 112 and does so in rapid fashion. The breaking of the frangible tab happens so quickly that the force applied by the earring-cartridge stud gun 12 is irreversibly transmitted to the earring cartridge 14 and drives the earring stud or post P through the ear and into the flanged aperture and through the curled springs of the earring nut N. In so doing, the elongated portion 150 of the nut jaw 114 compresses the earring cartridge spring 142 and travels to the rear of the earring jaw 112.

As the pierced-ear earring cartridge 116 is held in place by stops, the flexible tang 160 (moving with the elongated nut jaw portion) moves along the bottom side of the pierced-ear earring cartridge 116 until it finally reaches the back end 164 of the pierced-ear earring cartridge 116. Once past the back end of the cartridge 116, the flexible tang 160 is free to rise up and above the plane of the earring cartridge bottom.

The earring-cartridge blister pack 16 forms the majority of a sealable container within which the earring cartridge 14 and the pierced-ear earring E may be transported and stored until ready for use. The blister pack 16 allows and maintains sterilization of the earring cartridge 14 and the pierced-ear earring E.

The earring cartridge blister pack 16 is constructed to conform to the top of the earring cartridge 14. The conforming top 200 of the earring-cartridge blister pack 16 conforms to the top exterior of the earring cartridge 14 for a close but not constricting fit. Side indentations 202 provide gripping means by which a person's fingers may grip the blister pack and engage the earring cartridge 14 inside. As the earring cartridge 14 may take a variety of shapes, the shape achieved by the conforming top 200 of the blister pack 16 may also take the same variety of shapes in order to accommodate the earring cartridge 14. Between the flange 204 and the conforming top 200 is a circumscribing well 206.

The circumscribing well 206 allows the cradle 74 of the earring-cartridge stud gun 12 to fit within the blister pack 16 past the flange 204. This allows the earring-cartridge stud gun 12 to engage the earring cartridge 14 and remove it from the blister pack 16. This provides means by which the sterile nature of the earring cartridge 14 and the pierced-ear earring E may be maintained once the seal on the earring-cartridge blister pack 16 has been broken. Additionally, the earring cartridge 14 may be reinserted back into the blister pack after the ear-piercing process has been performed by fitting the earring-cartridge blister pack 16 over the earring cartridge 14 and removing the earring cartridge 14 from the cradle 74.

During manufacture and prior distribution, the earring cartridge 14 is fitted with a pierced-ear earring E within a pierced-ear earring cartridge 116. The earring cartridge is then fitted within the conforming top 200 of the earring cartridge blister pack 16. The bottom of the earring cartridge 14 is just above the flange 204 and within the confines of the blister pack 16. Ethane dioxide gas or the like may be introduced into the confines of the earring-cartridge blister pack 16 so as to sterilize its entire contents and any exposed surfaces, including the earring cartridge 14 and the pierced-ear earring E. Paper backing or the like 18 may be adhesively or otherwise sealingly attached to the flange 204. Where sterilizing ethane dioxide or other gas is used, it is then trapped within the earring-cartridge blister pack 16 to preserve and maintain the sterile environment previously established. Obviously, other sterilizing procedures may be used. The sealed, earring-cartridge blister pack 16 may then be transported and stored until ready for use, maintaining the earring cartridge 14 and its pierced-ear earring E in a sterile condition.

In operation, the earring-cartridge blister pack 16 with sterilized earring cartridge 14 is used in conjunction with the earring-cartridge stud gun 12 as follows. The earring-cartridge blister pack 16 is grasped at the indentations 202 to engage the sterilized earring cartridge 14 within. The paper backing 18 is then removed from its adhesive attachment with the flange 204. This exposes the bottom of the earring cartridge 14 and provides access to the cradle 74 to the interior of the earring-cartridge blister pack 16. The cradle 74 of the stud gun 12 is then brought into the confines of the earring-cartridge blister pack 16 to engage the bottom of the earring cartridge 14. Once the cradle 74 has securely engaged the earring cartridge 14, the blister pack 16 is then removed from the top of the earring cartridge 14. The ear lobe to be pierced may then be pierced by placing the ear lobe between the nut jaw 114 and the post P of the pierced-ear earring E. The ear lobe is sterilized prior to the ear-piercing process by swabbing with alcohol or the like.

The plunger 22 and the grip 20 are then pressed together to force the earring post into the earring nut N, breaking the frangible tab and piercing the ear lobe. The operation of the earring cartridge 14 during the ear-piercing process (see FIGS. 7 and 8) is generally the same as set forth in U.S. Pat. No. 5,496,343 issued to Reil on Mar. 5, 1996, as set forth above.

Figure 9:
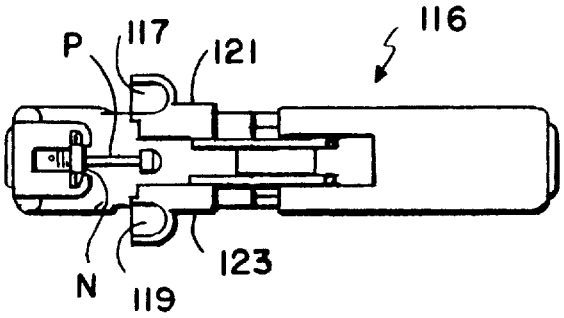
FIG. 9 is a view similar to FIGS. 7 and 8, showing the sequential action of the stud holders opening up but being retained to prevent reuse of the earring cartridge.

When fully compressed, the upper and lower abutment stops 28, 30 engage the grip 20 to stop all forward travel. Upon full compression, the ear has been pierced; and the earring post P has engaged the nut N. Pressure is then released from the hand upon the earring-cartridge stud gun 12, the pierced-ear earring cartridge halves 113 and 115 (FIG. 8) open up away from the pierced-ear earring E, the pierced-ear earring nut N is disengaged from the nut jaw 114, the ear has been pierced, and the earring-cartridge stud gun 12 with the earring cartridge 14 may then be removed from the area adjacent the pierced ear. Because of the termini portions 125 and 127 being retained, as seen in FIG. 9, the stud-holder halves 113 and 115 do not fall away, and preclude reloading of the cartridge to negate sterility. That is, the right-angle protuberances at the ends of termini portions 125 and 127 captively retain the cartridge halves 113 and 115 (FIG. 9) to prevent reloading of a stud and reuse of the earring cartridge.

The blister pack 16 may then be re-fitted over the used earring cartridge 14. By gripping the opposing indentations 202, the earring cartridge 14 within the earring-cartridge blister pack 16 may be engaged and removed from the cradle 74. By using the earring cartridge blister pack 16, the earring cartridge 14 need never be touched by human hands or other contaminating surface prior to, during, or after the ear-piercing process, thereby enhancing cleanliness and reducing the risk of any deleterious effects of the ear-piercing process.

Generally, the earring-cartridge blister pack is made of clear or other see-through plastics or materials so that the earring cartridge 14 and its pierced-ear earring E may be easily visible prior to the ear-piercing process. The earring-cartridge 14 and the earring-cartridge stud gun 12 may be made of lightweight but durable plastics that are easily formed into the appropriate shapes for use as set forth above.

Thus, in the instant invention a cartridge 14 is now designed not merely as a container for the pierced-ear Earring and the earring Nut, but also acts as a loading tool by which the earring-cartridge stud gun 12 may be loaded. It can be readily seen that by using the system disclosed that sterility and ease of handling for user of the system is accomplished.

While the present invention has been described with read to particular embodiments, it is recognized that additional variations of the present invention may be devised without departing from the inventive concept.

What I claim is:

1. An earring cartridge and stud gun system for providing sterile body piercing comprising in combination:

an earring cartridge, having a polygonal configuration and carrying a stud and a nut in slidably aligned, spaced apart, and oppositely opposed placement so that a body part may be placed between said stud and said nut for piercing;

an earring cartridge stud gun, said earring cartridge stud gun providing a cradle congruently configured to said earring cartridge and being adapted to engage and receive said earring cartridge, said earring cartridge stud gun being adapted to slidably drive said earring cartridge and to cause said stud to pierce said body part; and a blister pack, said blister pack being congruently configured to said earring cartridge and conformably accommodating said earring cartridge and being sealable to temporarily seal said earring cartridge within said blister pack; whereby said earring cartridge may be placed and sealed within said blister pack for transport and storage, and thereafter said blister pack being unsealed to expose said earring cartridge for placement within said cradle, said cradle receiving and removing said earring cartridge from said blister pack to provide and present said stud and said nut in aligned position for piercing said body part without the necessity of handling said earring cartridge with the hands of the operator.

2. The earring cartridge and stud gun system of claim 1, wherein said earring cartridge further comprises:

an earring jaw, said earring jaw holding head of said stud and alignedly positioning a post of said stud; and a nut jaw, said nut jaw slidably engaging said earring jaw, said nut jaw alignedly holding said nut opposite said earring, whereby said post engages said nut when said earring cartridge is compressed to bring said earring jaw towards said nut jaw.

3. The earring cartridge and stud gun system of claim 1, wherein said blister pack further comprises:

a blister top, said blister top conformably accommodating said earring cartridge and said portion of said cradle, said blister top having an extending flange circumscribing said blister top; and a backing sheet, said backing sheet adhesively attached to said flange to provide a seal and to seal said blister top; whereby said earring cartridge may be placed within said blister top and sealed within said blister pack when said backing sheet is adhesively attached to said flange.

4. An earring cartridge stud gun for engaging an earring cartridge, comprising:

a grip; a plunger, said plunger slidably engaging said grip; biasing means for biasing said plunger away from said grip, said grip having a front curved surface conformably engageable with the fingers of the hand of an operator, a cradle extension projecting forward of said front curved surface, said cradle extension having an upper surface spaced apart from a lower surface to define a tongue groove; and a cradle forestop projecting upwardly from an end of said cradle extension, said plunger having a rear curved surface conformably engageable with the heel of the hand of an operator; and a travelling portion coupled to said rear surface, said travelling portion adapted to compress an earring cartridge when the earring cartridge is placed in said cradle and said grip and said plunger are squeezed by said hand; and wherein said travelling portion has a cradle backstop; and a tongue, said tongue being coupled to said cradle backstop and travelling into a tongue groove defined in said grip when said plunger and said grip are squeezed, and wherein first and second stops are coupled to said plunger, said first and second stops abutting said grip when said grip and said plunger are squeezed, said first and second stops limiting the slidable insertion of said plunger into said grip whereby; a post held by the earring cartridge may engage a nut held by the earring cartridge without damaging said nut.

* * * * *